US008599091B2

(12) United States Patent
Yano

(10) Patent No.: US 8,599,091 B2
(45) Date of Patent: Dec. 3, 2013

(54) ANTENNA WITH BEAM DIRECTIVITY

(75) Inventor: Koji Yano, Nishinomiya (JP)

(73) Assignee: Furuno Electric Company Limited, Nishinomiya-shi (JP)

( * ) Notice: Subject to any disclaimer, the term of this patent is extended or adjusted under 35 U.S.C. 154(b) by 1273 days.

(21) Appl. No.: 11/880,015

(22) Filed: Jul. 19, 2007

(65) Prior Publication Data

US 2010/0026597 A1 Feb. 4, 2010

(30) Foreign Application Priority Data

Jul. 24, 2006 (JP) ..... 2006-200349

(51) Int. Cl.
*H01Q 13/00* (2006.01)

(52) U.S. Cl.
USPC ..... 343/772

(58) Field of Classification Search
USPC ..... 343/772, 702, 700 MS, 777, 785, 872
See application file for complete search history.

(56) References Cited

U.S. PATENT DOCUMENTS

| | | | | | |
|---|---|---|---|---|---|
| 4,373,782 | A | * | 2/1983 | Thelen | 398/79 |
| 4,488,157 | A | * | 12/1984 | Terakawa et al. | 343/771 |
| 4,841,308 | A | | 6/1989 | Terakawa et al. | |
| 5,117,240 | A | * | 5/1992 | Anderson et al. | 343/786 |
| 5,473,296 | A | * | 12/1995 | Ishikawa et al. | 333/239 |
| 5,757,330 | A | | 5/1998 | Parfitt | |
| 5,757,331 | A | * | 5/1998 | Yoneyama et al. | 343/783 |
| 6,097,346 | A | * | 8/2000 | Fehrenbach et al. | 343/785 |
| 6,333,719 | B1 | * | 12/2001 | Varadan et al. | 343/787 |
| 6,417,454 | B1 | * | 7/2002 | Biebuyck | 174/106 R |
| 6,791,496 | B1 | * | 9/2004 | Killen et al. | 343/700 MS |
| 6,819,296 | B2 | * | 11/2004 | Scorer et al. | 343/771 |
| 7,075,494 | B2 | * | 7/2006 | Sergey | 343/770 |
| 7,212,087 | B2 | * | 5/2007 | Nagai | 333/210 |
| 7,249,504 | B1 | * | 7/2007 | Wendler | 73/290 V |
| 7,408,522 | B2 | * | 8/2008 | Ahn et al. | 343/781 CA |
| 7,450,071 | B1 | * | 11/2008 | Volman | 343/700 MS |
| 2002/0053446 | A1 | * | 5/2002 | Moe et al. | 174/21 C |
| 2003/0095074 | A1 | * | 5/2003 | Scorer et al. | 343/772 |
| 2003/0179148 | A1 | * | 9/2003 | Ohlsson | 343/786 |
| 2005/0146479 | A1 | * | 7/2005 | Stenger et al. | 343/772 |

FOREIGN PATENT DOCUMENTS

| | | | | |
|---|---|---|---|---|
| JP | 1971016185 | | | 5/1971 |
| JP | 1985136516 | A | | 12/1986 |
| JP | 1994140823 | A | | 12/1995 |
| JP | 1997153729 | A | | 1/1999 |
| JP | 2001-42024 | | | 2/2001 |
| JP | 2001042024 | | * | 2/2001 |
| JP | 2001042024 | A | | 2/2001 |
| JP | 3634372 | | | 1/2005 |
| JP | 2005-117543 | | | 4/2005 |

* cited by examiner

*Primary Examiner* — Huedung Mancuso
(74) *Attorney, Agent, or Firm* — Nutter McClennen & Fish LLP; John J. Penny, Jr.; Christina M. Sperry

(57) ABSTRACT

An antenna comprising a radiator which is configured to radiate electromagnetic wave inside of an antenna housing, and at least one dielectric which is configured to be contributory to directivity angle of the electromagnetic wave in the vertical direction, wherein the at least one dielectric is directly attached to the antenna housing ahead of the radiator.

16 Claims, 4 Drawing Sheets

ANTENNA WITH BEAM DIRECTIVITY

FIELD OF THE INVENTION

The present invention relates to an antenna used for a radar for detecting the presence of targets on the sea and so forth by sending and receiving beams.

BACKGROUND OF THE INVENTION

The antenna used for a radar for detecting the presence of targets at sea and so forth is generally a slot array antenna which sends and receives beams through slots provided on the front panel of a radiator. In this manner, it is possible to improve azimuth resolution by narrowing beam width in the horizontal direction when sending and receiving beams through the slots. Also, 360° degrees of detection is carried out by turning the whole antenna.

In order to detect effectively along a horizontal surface such as the surface of the sea, the beam width must be narrowed down in the vertical direction. However, the radar cannot detect the targets well when the beam width is too narrow, since the beams are jolted out of alignment from targets, for example, when an antenna is fixed on swaying objects such as ships. Accordingly, it is necessary to narrow the beam width in the vertical direction to the extent that the targets can continue to be detected in the presence of some sway.

The whole antenna is enclosed by a housing to minimize external influences such as weather or to provide safety and so forth. However, when beams are radiated outside of the antenna housing and are partly reflected by the antenna housing, interference occurs among these beams, causing side-lobe. Since such side-lobe leads to deterioration of detection accuracy, reduction of the side-lobe is also required.

The antenna 30 is disclosed in Japanese Patent No. 3,634,372 (U.S. Pat. No. 5,757,330) and U.S. Pat. No. 6,819,296. The antenna 30 is described below by referring to FIG. 7 showing the configuration of the antenna 30.

The antenna 30 comprises a radiator 31, slots 32, a transition portion 33, dielectrics 34*a-c*, antenna housing 35*a-b*, a support member 36.

The antenna 30 is provided with slots 32 in front of the radiator 31. It is possible to narrow the beam width in the horizontal direction by way of the slots 32. Narrowing the beam width in the horizontal direction can improve the azimuth resolution of the antenna 30. The dielectrics 34*a-c* are provided through the transition portion 33 ahead of the radiator 31. The height of the transition portion 33 is practically equal to the height of the antenna housing 35*a-b* made up of the dielectric material, and the transition portion 33 electromagnetically-couples efficiently between the radiator 31 and the dielectrics 34*a-c*.

By providing the dielectrics 34*a-c* ahead of the radiator 31, it is possible to keep the beam from spreading in the vertical direction and to keep the beam narrow in width. That is to say, it is possible to determine desired beam width by changing permittivity and length of the dielectrics 34*a-c*.

The dielectrics 34*a-c* are provided with their longitudinal sides disposed in the direction of the radial axis showing the center of radiation. The dielectrics 34*a-c* and the antenna housing 35*a-b* are provided in the form of a layer nearly perpendicular to the radial axis and uniformly spaced in the order of upper surface 35*a* of the antenna housing, a dielectric 34*a*, a dielectric 34*b*, a dielectric 34*c*, and lower surface 35*b* of the antenna housing. Furthermore, the dielectrics 34*a-c* are supported by the support member 36 disposed in the antenna housing 35*a-b*. In this manner, since the dielectrics 34*a-c* and the antenna housing 35*a-b* are provided in the form of a layer, interference occurs (that is, interference among the layers of the dielectrics 34*a-c*) which is attributable to interference between the upper surface 35*a* of the antenna housing and the lower surface 35*b* of the antenna housing, which causes the side-lobe. It is possible to reduce the side-lobe of the beam radiated outside of the antenna housing 35*a-b* due to interaction of each individual interference.

In addition, although the support member 36 is made of the dielectric material similar to the dielectrics 34*a-c*, the support member does not contribute greatly to different permittivity, narrowing of the beam width, and reduction of the side-lobe. Therefore, the dielectrics and the support member shall be classified into different factors in view of object and effect.

The antenna 30, however, is heavier due to the presence of dielectrics 34*a-c* and the support member 36. In general, with regard to the antenna capable of radiating desired beams, its weight is enumerated as one of the important subjects to be improved. The antenna is rotated by a motor for 360° degrees of detection around the antenna. Therefore, as antenna weight increases, the power of the motor must be increased and the strength of a base supporting the antenna must also be increased.

For the antenna 30 described in Japanese Patent No. 3,634,372, the support member 36 is required to dispose and support the dielectrics 34*a-c*. In addition, it is necessary to form insertion slots for disposing the dielectrics 34*a-c* in the support member 36, which complicates the manufacturing process of the antenna 30.

The present invention is devised to address the above-mentioned problems. It is an object of the invention to provide an antenna with small side-lobe while narrowing the beam width to a desired width without increasing antenna weight. It is also an object of the invention to reduce the manufacturing requirements and the cost. Furthermore, it is also an object of the invention to improve stability during antenna rotation.

SUMMARY OF THE INVENTION

In order to solve the above-mentioned problems, the invention, in one aspect, is directed to an antenna characterized by comprising a radiator which is configured to radiate electromagnetic waves inside of an antenna housing, at least one dielectric which is configured to be contributory to directivity angle of the electromagnetic wave in the vertical direction, and characterized in that the dielectric is attached to the antenna housing ahead of the radiator.

DETAILED DESCRIPTION

Figure 1:
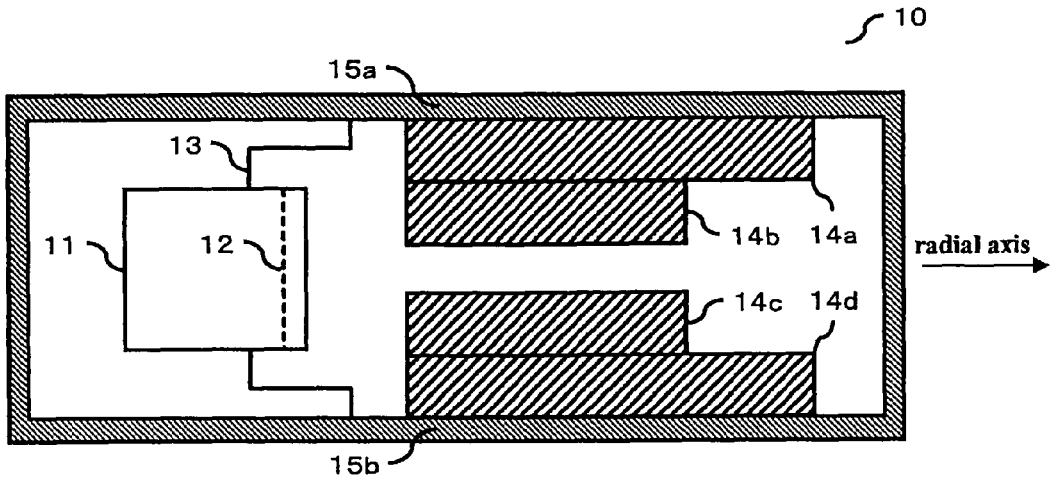
FIG. 1 is an end elevation showing one example of the configuration of the antenna in one embodiment according to the invention.

The antenna 10 in one embodiment of the invention is described below by referring to FIG. 1 showing an end elevation of one example of the configuration of the antenna.

The antenna 10 comprises a radiator 11, slots 12, a transition portion 13, a plurality of dielectrics 14*a-d*, and antenna housing 15*a-b*.

The antenna 10 is provided with slots 12 in front of the radiator 11. It is possible to narrow the beam width of the electromagnetic wave radiated from the radiator in the horizontal direction by way of the slots 12. Narrowing the beam width in the horizontal direction can improve the azimuth resolution of the antenna 10. The dielectrics 14*a-d* are provided through the transition portion 13 ahead of the radiator 11. The height of the transition portion 13 is practically equal to the height of the antenna housing 15*a-b*, and the transition portion 13 electromagnetically-couples efficiently between the radiator 11 and the dielectrics 14*a-d*.

The dielectrics 14*a-d* are provided with longitudinal sides in parallel to the direction of the radial axis. Since the beam width in the vertical direction depends on the permittivity and length of the dielectrics 14*a-d*, it is possible to obtain desired beam width by changing these factors. The length of the dielectrics 14*b* and 14*c* are shorter than that of the dielectrics 14*a* and 14*d* as described below, with the end positions of the dielectrics 14*a-d* on the radiator side aligned to each other. Therefore, since the weight is more concentrated on the inner side than on the outer side of the antenna 10, it is possible to impart more stability to the antenna 10 when rotated.

The dielectrics 14*a-d* and the antenna housing 15*a-b* are provided in the form of a layer nearly perpendicular to the radial axis in the order of upper surface 15*a* of the antenna housing, the dielectric 14*a*, the dielectric 14*b*, the dielectric 14*c*, the dielectric 14*d*, and the lower surface 15*b* of the antenna housing. In addition, the outermost dielectrics 14*a* and 14*d* are in close contact with the antenna housing 15*a* and 15*b*, respectively. Furthermore, one side of the dielectric 14*b* comes into contact with the dielectric 14*a*, and one side of the dielectric 14*c* comes into contact with the dielectric 14*d*. In this manner, at least one side of the dielectrics 14*a* and 14*d* comes in contact with the antenna housing 15*a-b* and other dielectrics 14*b* and 14*c*. Therefore, when the dielectrics 14*a-d* are provided inside of the antenna housing 15*a-b*, it is possible to reduce the number of components without requiring a separate support member and so forth. Furthermore, the weight of the antenna can be reduced.

The dielectrics 14*a-d* are provided symmetrically and perpendicularly to the radial axis. The permittivity and length of the dielectrics 14*a* and 14*d* and/or the dielectrics 14*b* and 14*c* are equally set, respectively. This allows the directivity characteristics of the beam to be symmetric with respect to the radial axis. However, since asymmetric configuration can also tilt and radiate the beam, it is not always necessary for the dielectrics 14*a-d* to be symmetric.

In another embodiment, a foam dielectric can be used for the dielectrics 14*a-d*. The use of a foam dielectric enables the permittivity to be simply adjusted depending on the degree of foaming (i.e., the amount of air in the foam dielectric). As the degree of foaming increases, the permittivity of the foam dielectric decreases. In addition, as the weight of the foam dielectric decreases, the density of the foam dielectric decreases, and the foaming density (i.e., the amount of air in the foam dielectric) increases. Accordingly, it is also possible to lighten its weight.

The permittivity and length of the dielectrics 14*a-d* can be determined using simulation so that a beam obtains the desired directivity characteristics. Each value of dielectrics 14*a-d* is described below in conjunction with the result of a simulation for the directivity characteristics of the antenna 10.

Figure 2:
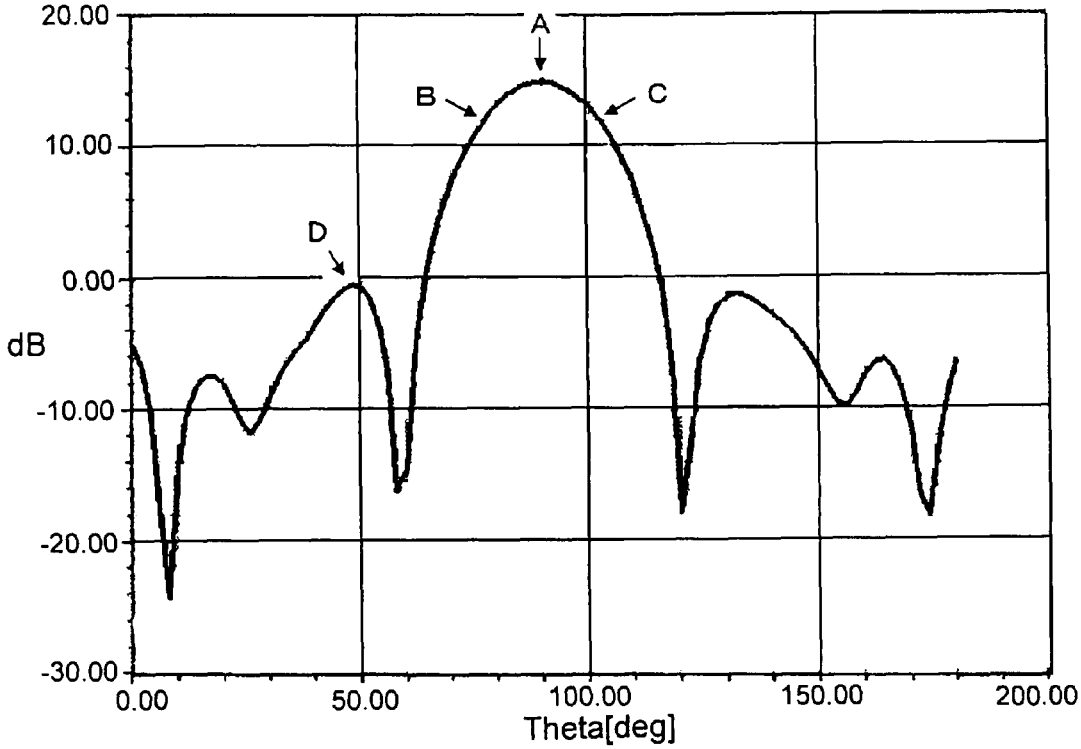
FIG. 2 is a view showing the result of simulation for the directivity characteristics of the antenna according to the embodiment of the invention shown in FIG. 1.
Figure 3:
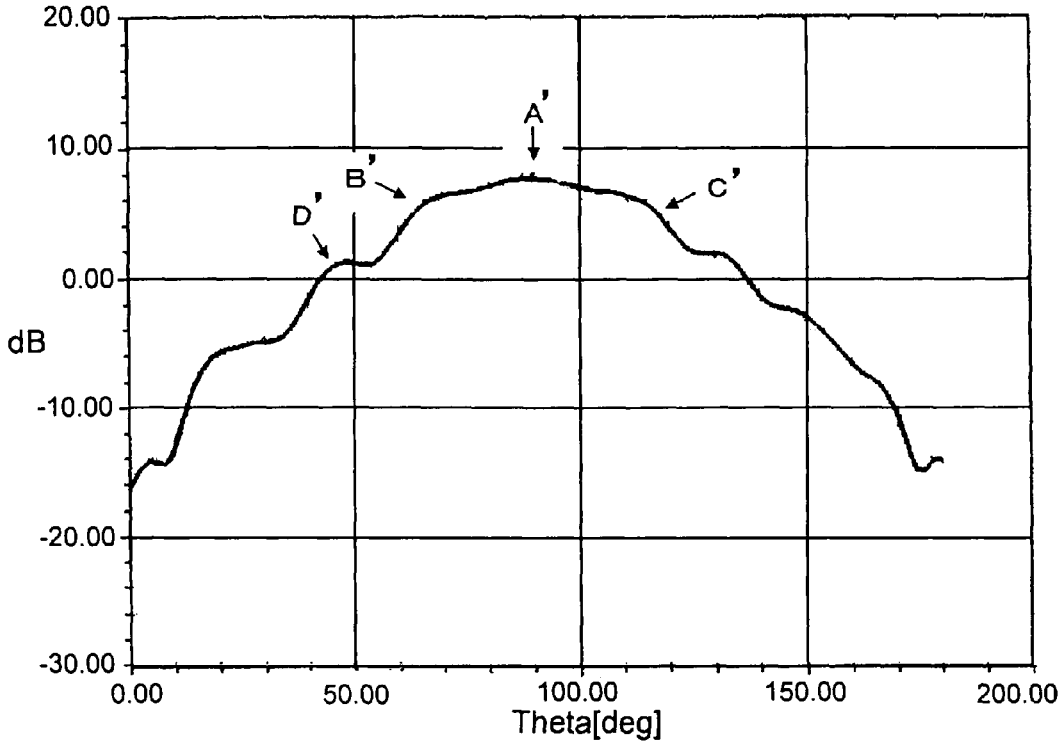
FIG. 3 is a view showing the result of simulation when dielectric and antenna housing are not considered.

FIG. 2 shows the result of a simulation for the directivity characteristics of the antenna 10. The results of FIG. 2 can be compared to FIG. 3 showing the results of a simulation wherein dielectrics 14*a-d* and antenna housing 15*a-b* are not considered. In FIGS. 2 and 3, the axis of abscissas indicates an angle, and an axis of ordinate indicates a gain. The dielectrics 14*a-d* are disposed at a distance of 20 mm from the radiator 11. The dielectrics 14*a* and 14*d* are 1.5 in permittivity, 80 mm in length, and 7.0 mm in height. The dielectrics 14*b* and 14*c* are 1.3 in permittivity, 62 mm in length, and 7.0 mm in height. In addition, the antenna housing is 4.0 in permittivity, 32 mm in height, and 1.0 mm in thickness. These values are experimentally calculated so that adequate gain is obtained at 25° of directivity angle of a beam, provided that one wavelength is 32 mm. The antenna, however, is not restricted to these values. Directivity angle generally represents a range of angles in which a difference of gain from a point (with highest gain) in the direction of radial axis is within 3 dB.

With regard to the result of the simulation shown in FIG. 2, point A (θ=90°) indicates the direction of radial axis, and points B (θ=78°) and C (θ=103°) indicate a maximum directivity angle of a beam. In addition, point D (θ=48°) indicates a point where the side-lobe occurs significantly. It is found from FIG. 2 that a beam with desired directivity angle can be formed in a configuration like the antenna 10. Furthermore, it is also found in reference to the side-lobe that a gain can be reduced up to a difference of about 15 dB or more as compared with that at point A (θ=90°) in the direction of radial axis of a beam. Accordingly, it is found that suitable beams for detecting targets at sea can be obtained by providing the antenna 10 with dielectrics 14*a-d* configured at the above-mentioned values.

With regard to the result of a simulation as shown in FIG. 3, point A' (θ=90°) indicates the direction of the radial axis of a beam, and points B' (θ=65°) and C (θ=115°) indicate a maximum directivity angle of a beam. In addition, point D' (θ=45°) indicates a point where the side-lobe occurs significantly. In FIG. 3, it is found that directivity angle of a beam is about 60° when the dielectrics 14*a-d* and the antenna housing 15*a-b* are not taken into account. That is to say, it is confirmed that the directivity angle of a beam is appropriately narrowed in the configuration of the antenna 10. A difference of gain between the point D' (θ=45°) where the side-lobe occurs significantly and the point A (0=90°) in the direction of radial axis of a beam is about 7 dB. Namely, it is confirmed that, in reference to the side-lobe, the gain can also be reduced greatly in comparison with the gain in the radial axis.

In the above-mentioned configuration, the antenna can radiate a beam with small side-lobe in a desired beam width. Since it is not necessary to support the dielectrics with a support member and so forth, the weight of the antenna can be reduced. Furthermore, since the weight is more concentrated on the inner side than on the outer side of the antenna, is possible to impart more stability to the antenna 10 when rotated. Furthermore, since a support member is not required to provide support to an insertion slot and the antenna, it is possible to reduce the manufacturing requirements and the cost.

It is also possible to increase antenna 10 stability by filling in the space between the dielectrics 14*b* and 14*c*. Although there is a clearance between the dielectrics 14*b* and 14*c* of the antenna 10, it is possible to obtain a desired beam by adjusting the permittivity and size of the dielectrics 14*a-d* without creating clearance.

Figure 4:
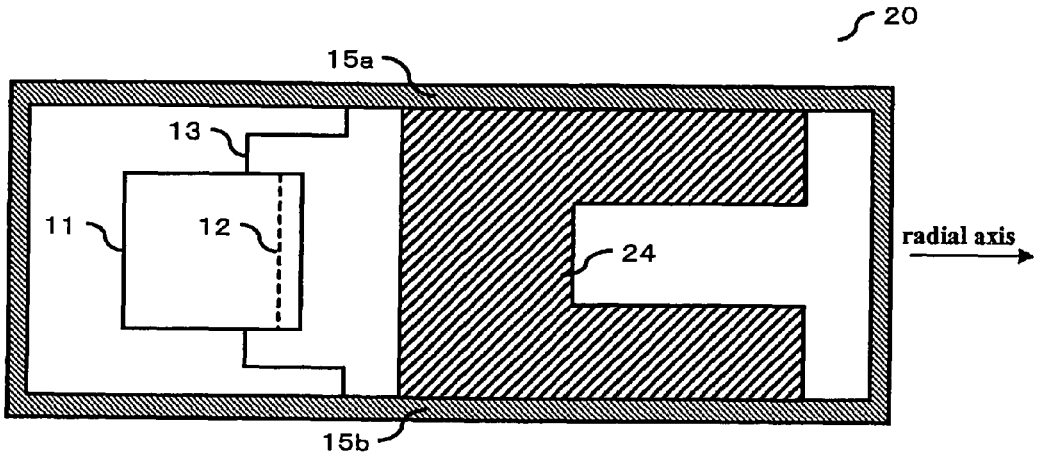
FIG. 4 is an end elevation showing one example of the configuration of the antenna in another embodiment according to the invention.

In another embodiment, the antenna 20 is described below by referring to FIG. 4 showing an end elevation of one example of the configuration of the antenna 20.

The dielectric 24 of an antenna 20 is characterized as being a concave form.

This dielectric 24 is in close contact with both upper and lower portions of the antenna housing 15*a-b* disposed ahead of a radiator 11. Furthermore, the dielectric 24 can have a length extending in the direction of the radial axis which can become longer the further away it is from the radial axis.

Furthermore, a foam dielectric can be used for the dielectric 24 wherein the foaming rate of the dielectric becomes low from the radial axis to the antenna housing in the vertical direction. Since the permittivity of the foam dielectric depends on its foaming rate, it is possible to increase the permittivity by decreasing the foaming rate. That is to say, the permittivity of the dielectric 24 increases from the radial axis to the antenna housing in the vertical direction.

Figure 5:
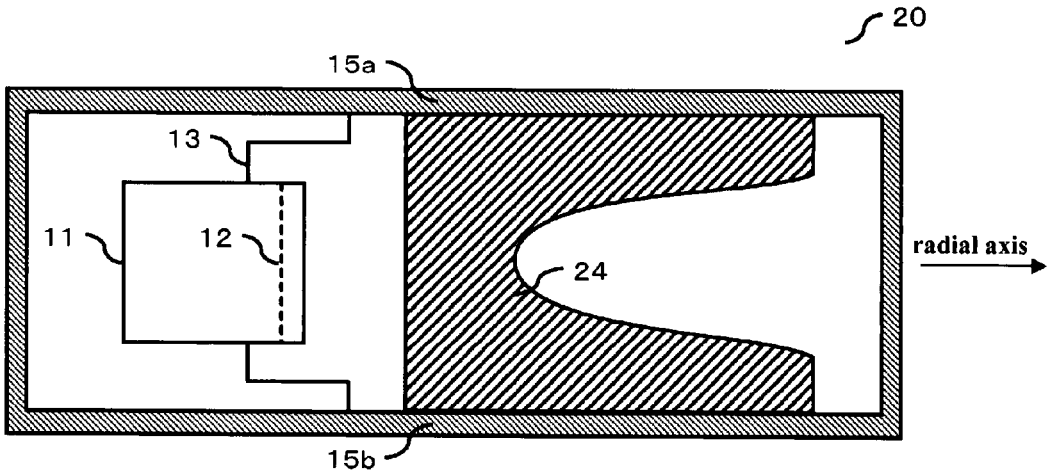
FIG. 5 is an end elevation showing one example of the configuration of the antenna in the embodiment shown in FIG. 4.
Figure 6:
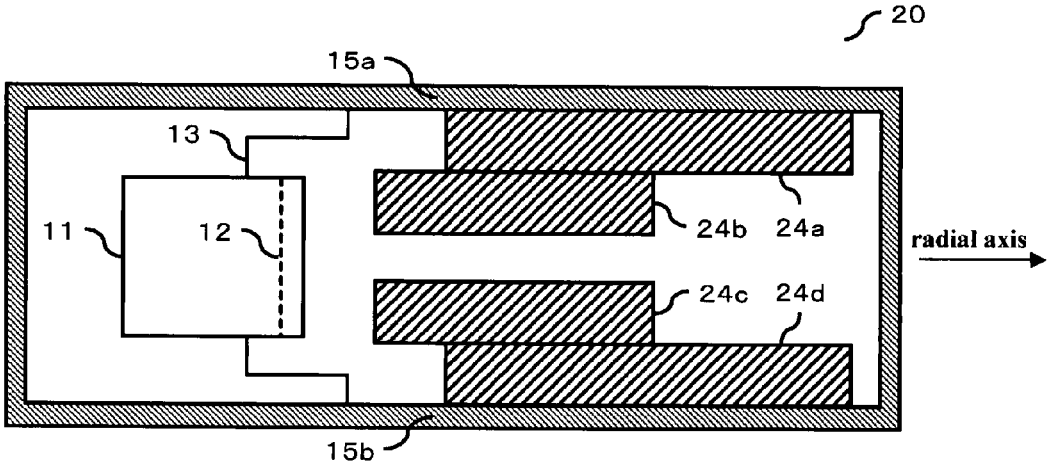
FIG. 6 is an end elevation showing one example of the configuration of the antenna in the embodiment shown in FIG. 4.
Figure 7:
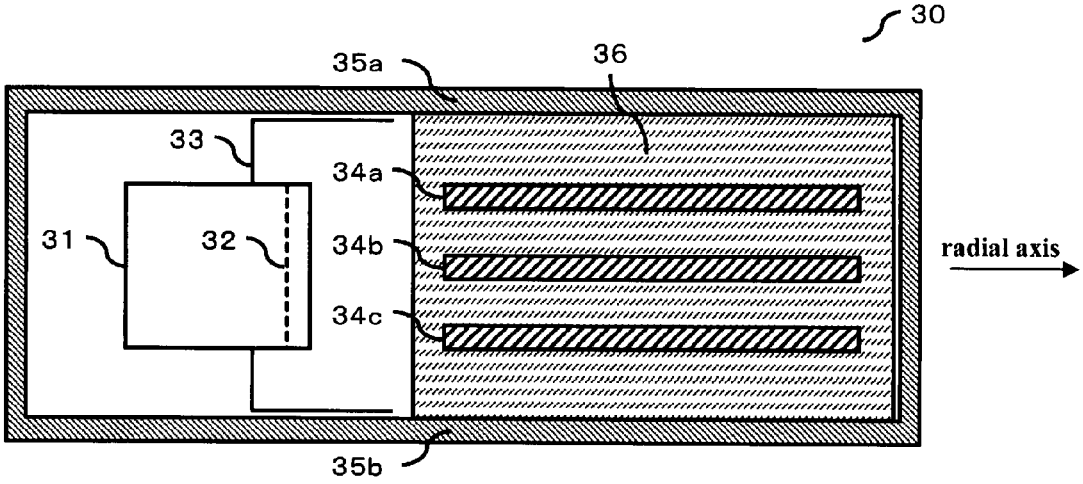
Fig.7 Related Art
FIG. 7 is an end elevation showing the configuration of the antenna according to related art.

In another embodiment, the dielectric 24 can have its length changed radially as shown in FIG. 5. In another embodiment, the dielectrics 24 can be in the form of a layers as shown in FIG. 6. For example, the ends of the dielectrics 24*a-d* can be disposed at unequal distances from the radiator side of the radiator 11 to obtain desired properties of the antenna 20.

The invention is not restricted to the embodiments described above. For example, the invention is also applicable to a radome type antenna which rotates a radiator portion within a fixed antenna housing. Furthermore, the invention is not limited to use on ships to detect targets at sea, but may also be mounted on other vehicles such as aircraft and so forth for carrying out other types of detection.

According to the invention, it is possible to manufacture a light weight antenna capable of radiating the beams with desired beam width and small side-lobe. Furthermore, it is also possible to decrease the manufacturing process and reduce the cost. Furthermore, it is also possible to improve stability when the antenna is rotated.

I claim:

1. An antenna comprising:

an antenna housing;

a radiator which is configured to radiate an electromagnetic wave inside of the antenna housing;

at least one dielectric which is configured to be contributory to directivity angle of the electromagnetic wave in a vertical direction; and at least one additional dielectric;

wherein the at least one dielectric has a side that extends in a direction that is parallel to a radial axis of the electromagnetic wave, wherein a whole of the side is directly attached to an upper or a lower portion of the antenna housing, and wherein the at least one dielectric is longer than the at least one additional dielectric, and the at least one dielectric is placed farther from the inside toward the outside of antenna housing in the vertical direction than the at least one additional dielectric.

2. The antenna as set forth in claim 1:

wherein a permittivity of the at least one dielectric varies from an inside toward an outside of the antenna housing in the vertical direction.

3. The antenna as set forth in claim 1:

wherein a plurality of dielectrics are configured in layers in the vertical direction.

4. The antenna as set forth in claim 1:

wherein a permittivity of the at least one dielectric is symmetric.

5. The antenna as set forth in claim 1:

wherein the at least one dielectric is a foam dielectric.

6. The antenna as set forth in claim 1:

wherein the side is a longitudinal side of the at least one dielectric.

7. The antenna as set forth in claim 1:

wherein the at least one additional dielectric has a side that extends in a direction that is parallel to the radial axis of the electromagnetic wave.

8. The antenna as set forth in claim 7:

wherein the at least one dielectric comprises two dielectrics, and the at least one additional dielectric comprises two dielectrics.

9. An antenna comprising:

an antenna housing;

a radiator which is configured to radiate an electromagnetic wave inside of the antenna housing;

at least one dielectric which is configured to be contributory to directivity angle of the electromagnetic wave in a vertical direction; and at least one additional dielectric;

wherein a whole of a length of a longitudinal side of the dielectric is directly attached to an upper or a lower portion of the antenna housing, the side extending in a direction that is parallel to a radial axis of the electromagnetic wave, and the longitudinal side of the dielectric being longer than a latitudinal side of the dielectric that is connected to the longitudinal side, and wherein the at least one dielectric is longer than the at least one additional dielectric, and the at least one dielectric is placed farther from the inside toward the outside of antenna housing in the vertical direction than the at least one additional dielectric.

10. The antenna as set forth in claim 9:

wherein a permittivity of the at least one dielectric varies from an inside toward an outside of the antenna housing in the vertical direction.

11. The antenna as set forth in claim 9:

wherein the at least one additional dielectric has a side that extends in a direction that is parallel to the radial axis of the electromagnetic wave.

12. The antenna as set forth in claim 11:

wherein the at least one dielectric comprises two dielectrics, and the at least one additional dielectric comprises two dielectrics.

13. The antenna as set forth in claim 9:

wherein a plurality of dielectrics are configured in layers in the vertical direction.

14. The antenna as set forth in claim 9:

wherein a permittivity of the at least one dielectric is symmetric.

15. The antenna as set forth in claim 9:

wherein the at least one dielectric is a foam dielectric.

16. The antenna as set forth in claim 9:

wherein an entirety of a length of the latitudinal side of the dielectric is not directly attached to the antenna housing.

* * * * *